United States Patent [19]

Serpico

[11] Patent Number: 4,665,668

[45] Date of Patent: May 19, 1987

[54] PERSONAL TIME CAPSULE

[76] Inventor: Robert M. Serpico, 192 Lowell Ave., Floral Park, N.Y. 11001

[21] Appl. No.: 835,618

[22] Filed: Mar. 3, 1986

[51] Int. Cl.[4] ..... B65D 41/04; B65D 51/18

[52] U.S. Cl. ..... 52/169.2; 52/169.6; 220/256; 220/290

[58] Field of Search ..... 220/256, 255, 290, 253; 52/169.2, 169.6

[56] References Cited

U.S. PATENT DOCUMENTS

| | | | |
|---|---|---|---|
| D. 130,989 | 1/1942 | Adams | D34/1 |
| 1,351,747 | 9/1920 | Flinn | 220/1 T |
| 2,337,456 | 12/1943 | Draper | 220/256 |
| 2,343,286 | 3/1944 | Dodson | 220/256 |
| 2,480,096 | 8/1949 | Hoffman | 220/253 |
| 2,519,572 | 8/1950 | Hill | 220/256 |
| 2,705,088 | 3/1955 | Blarcom | 220/256 |
| 2,796,191 | 6/1957 | Belanger | 220/256 |
| 2,838,196 | 4/1958 | Chapman | 220/256 |
| 4,582,668 | 4/1986 | Mallory et al. | 220/256 |

FOREIGN PATENT DOCUMENTS

| | | | |
|---|---|---|---|
| 784533 | 5/1968 | Canada | 220/256 |
| 1607867 | 3/1979 | Fed. Rep. of Germany | 220/256 |
| 2009718 | 6/1979 | United Kingdom | 220/290 |

*Primary Examiner*—William F. Pate, III
*Assistant Examiner*—Michael Safavi
*Attorney, Agent, or Firm*—Richard L. Miller

[57] ABSTRACT

Presented is a personal time capsule for the preservation of artifacts over a period of hundreds of years. Constructed of non corrosive high strength materials. A body containing the cavity for storage is hermetically and water tight sealed with an inner sealing member, O-rings a gasket and a cover cap which is threaded to the body. A bolt is used to secure the inner sealing member and the cover cap.

1 Claim, 5 Drawing Figures

PERSONAL TIME CAPSULE

BACKGROUND OF THE INVENTION

This invention relates to enclosures for the preservation of materials; and more particularly to a personal time capsule.

Vaults and enclosures of various types have been used for many years. Such enclosures are large, heavy and primarily used for heavy equipment. Many of these enclosures have been subject to corrosion, galvanic action and the deteriorating effects of weather, air, water and external forces. Devices for enclosures of this general character are shown in U.S. Pat. Nos. 3,974,599; 4,233,789 and 4,158,102.

Therefore, there exists a need for a small capsule capable of withstanding hundreds of years without decomposing, which is hermetically sealed and water tight.

SUMMARY OF THE INVENTION

It is therefore an object of this invention a provide a new and improved personal time capsule.

It is another object of this invention to provide a new and improved hermetically sealed personal time capsule.

It is yet another object of this invention to provide a new and improved water tight hermetically sealed personal time capsule.

It is still a further object of this invention to provide a new and improved personal time capsule capable of withstanding hundreds of years without deterioration.

It is yet still another object of this invention to provide a new and improved personal time capsule of withstanding extremes of temperature and pressure.

It is an additional object of this invention to provide new and improved personal time capsule weighted so as to sink in water.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
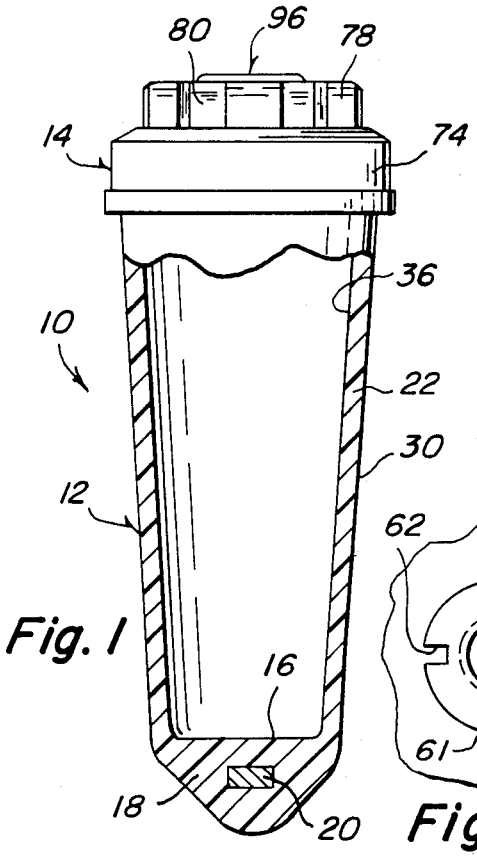
FIG. 1 is an elevational view with parts broken away of the invention.
Figure 4:
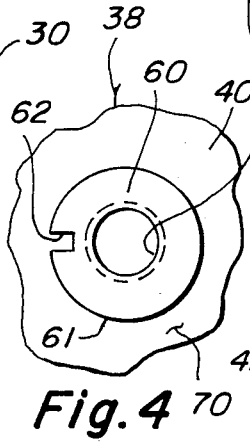
FIG. 4 is an enlarged top plan view of the inner sealing member with parts broken away as indicated by arrow 4 in FIG. 2.
Figure 2:
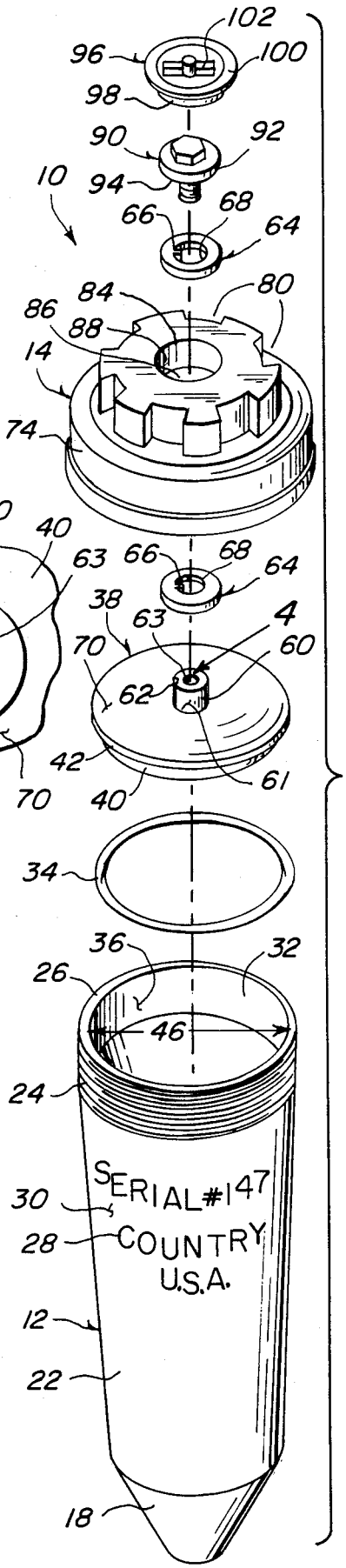
FIG. 2 is an exploded perspective view thereof.
Figure 5:
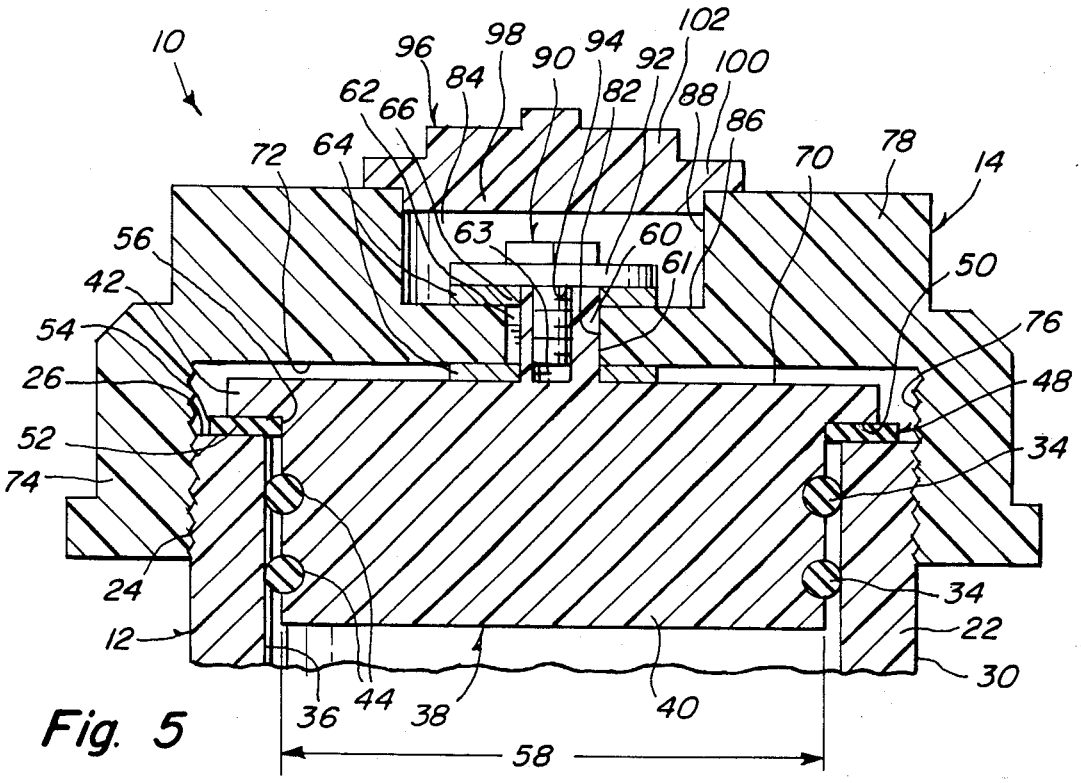
FIG. 5 is a cross section view of the top cover portion of FIG. 1.

With reference to FIG. 1 there is shown a personal time capsule 10 with a body 12 and cover cap 14. Typical materials of construction for the individual parts of the personal time capsule 10 are corrosion resistant stainless, MONEL TM, aluminum, high impact plastic or other similar materials. Body 12 is of essentially cylindrical form tapered at a closed end 16 from which extends a conical portion 18. Embedded in this conical portion is a weight 20 proximate to the center thereof. Body 12 is casted or molded of one of the aforementioned material with a wall 22 of large predetermined thickness. An externally threaded portion 24 proximate to a top edge 26 (FIG. 2) is cut or rolled into wall 22. An identification 28 is embossed onto an external surface 30 of wall 22. Coincidence with a plain defined by top edge 26 is an opening 32 of a diametral size equal to the diameter of body 12 at top edge 26 less twice the thickness of wall 22 at top edge 26. In FIGS. 2 and 5 there is shown a set of O-ring seals 34 which coact with an inner surface 36 of body 12. An inner sealing member 38 comprised of a plug portion 40 and a flange portion 42 disk like in form. Plug portion 40 being essentially cylindrical with a diameter of predetermined size to coact with O-ring seals 34 and inner surface 36 of body 12 when O-rings 34 are disposed in a set of O-ring grooves 44 which are cut into the periphery of plug portion 40 of inner sealing member 38. Flange portion 42 has a diameter larger than an inside diameter 46 at top edge 26 of body 12. A gasket 48 coacts with an underside 50 of flange portion 42. A gasket 48 in the form of a flat washer having a thickness 52, an outside diameter 54 about the same size as the diameter of flange portion 42 and an inside diameter 56 larger than a diameter 58 of plug 40. Concentric with plug portion 40 and flange portion 42 of inner sealing member 38 is a washer locking portion 60. A slot 62 (FIG. 4) is vertically cut into an outside wall 61, which is cylindrical, and internal thread 63 is deployed concentric to wall 61 of locking portion 60 of inner sealing member 38. Aforementioned slot 62 coacts with a pair of washer 64, each washer having a teat 66 of predetermined size protruding from an inside diameter 68 of washer 64. First washer 64 is disposed between a top surface 70 of flange portion 42 of inner sealing member 38 and an inside bottom surface 72 of cover cap 14.

Figure 3:
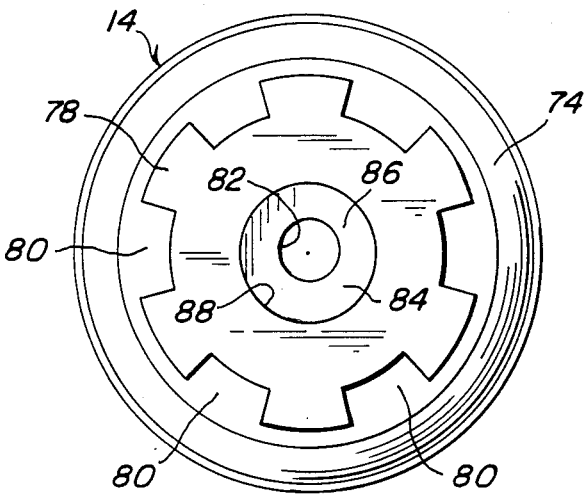
FIG. 3 is an enlarged top plan view of just cover cap.

Cover cap 14 is of complex form having a first portion 74 in the form of a heavy tubular member with an internal thread 76 which coacts with thread 24 of body 12. A second portion 78 of cover cap 14 cylindrical in form and has a set of radical grasping slots 80 (FIG. 3) disposed about the periphery of second portion 78 of cover cap 14. A clearance hole 82 is located in the center of cover cap 14 concentric with a recess 84. Recess 84 is in the form of a cylindrical cavity with a bottom 86 and a side 88. Second washer 64 is positioned on bottom 86 of recess 84 of cover cap 14. A bolt 90 with a washer 92 integral to bolt 90 coacts with internal thread 63 of inner sealing member 38. An underside 94 of washer 92 is displaced on second washer 64.

A top cap 96 is in the form of a first cylindrical portion 98 and a second cylindrical portion 100 concentric to each other and a tightening bar 102 in a form of a rectangular strip is affixed to second portion 100 by conventional methods. Top cap 96 coacts with recess 84 of cover cap 14 by means of a pressfit. Assembly of personal time capsule 10 is achieved by placing O-rings 34 on inner sealing member 38, placing gasket 48 on edge 26 of body 12, inserting inner sealing member 38 into opening 32 of body 12, placing washer 64 on locking portion 60 of inner sealing member 38, next cover cap 14 is threaded to body 12, second washer 64 is then disposed on locking portion 60, bolt 90 is then secured to inner sealing member 38 and top cap is fixed to cover cap 14.

This construction allows the capsule to be easily sealed (or unsealed as the case may be) air tight using just ordinary strength by twisting the cover cap 14 on the thread portion 24 of body 12. The mechanical advantage of thread portion 24 thus causes gasket 48 to be compressed at the same time that O-rings 34 are force into space between plug 40 and body 12.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A personal time capsule, comprising:

(a) a body having a first portion in the shape of a tapered cylinder with external threads proximate a top end and a second portion in a shape of a cone;

(b) an inner sealing means comprising; a first portion in a shape of a cylinder, a second portion disk like in size diametrically larger than said first portion and concentric thereto and a third cylindrical portion disposed concentric to said second portion;

(c) a multiplicity of O-rings disposed on a periphery of said first portion of said inner sealing means;

(d) a cover cap coacting with said body with a tubular first portion internally threaded;

(e) a pair of washers coacting with said inner sealing means and cover cap;

(f) a bolt with an integral washer which coacts with said inner sealing means;

(g) a top cap which coacts with said cover cap;

(h) said body being of a size and configuration corresponding to said cover cap so that when attached together by said external and said internal threads said body and cover cap present the appearance of a unitary container, wherein said body has a hollow cavity for the purpose of holding personal documents and artifacts therein, wherein non corrosive, materials are used so as to render said personal time capsule impervious to hundreds of years of exposure, wherein said washers have teats disposed on inside diameters which coact with a slot in a third portion of said inner sealing means.

* * * * *